US006053998A

United States Patent [19]

Nitta et al.

[11] Patent Number: 6,053,998

[45] Date of Patent: Apr. 25, 2000

[54] METHOD OF MANUFACTURING RUST-PREVENTING COVER

[75] Inventors: Makoto Nitta, Toyota; Haruyuki Yamazaki, Nagoya, both of Japan

[73] Assignees: Toyota Jidosha Kabushiki Kaisha, Toyota; Nihon Sekiso Industries Co., Ltd., Nagoya, both of Japan

[21] Appl. No.: 08/788,880

[22] Filed: Jan. 22, 1997

[30] Foreign Application Priority Data

Jan. 25, 1996 [JP] Japan ..... 8-011006

[51] Int. Cl.[7] ..... B28B 1/26

[52] U.S. Cl. ..... 156/62.4; 156/300; 264/87; 264/101; 264/115; 264/DIG. 69

[58] Field of Search ..... 264/87, 86, 101, 264/102, 115, 109, DIG. 69; 156/62.2, 62.4, 278, 182, 183, 228, 242, 245, 297, 300

[56] References Cited

U.S. PATENT DOCUMENTS 4,204,907 5/1980 Korkian et al. ..... 264/87
4,363,770 12/1982 Philips ..... 264/87

FOREIGN PATENT DOCUMENTS 688852 7/1950 United Kingdom .

*Primary Examiner*—Jan H. Silbaugh
*Assistant Examiner*—Kenneth M. Jones
*Attorney, Agent, or Firm*—Kenyon & Kenyon

[57] ABSTRACT

A method of manufacturing a rust-preventing cover in which sufficient strength during mounting is ensured and which can be easily removed when not needed. The method of manufacturing a rust-preventing cover is carried out by a WFM manufacturing method rather than a conventional DFM manufacturing method. A mixed aqueous solution having paper fibers as a main material thereof is stored in a water tank. A porous rust-preventing cover mold is immersed therein. Then, the mixed aqueous solution is sucked by a vacuum pump. In this way, a paper fiber surface layer, which later becomes a rust-preventing cover, is formed on a surface of a mold main body of the rust-preventing cover mold at portions to which masking has not been applied. By adjusting a suction time of the vacuum pump, a rust-preventing cover of an arbitrary thickness which corresponds to a thickness required during mounting can be obtained. Further, because breakage strength of the rust-preventing cover is based on bonding of paper fibers, the rust-preventing cover can be broken and removed easily.

11 Claims, 12 Drawing Sheets

106
108
104
76
80
98
90
100
102
P

METHOD OF MANUFACTURING RUST-PREVENTING COVER

BACKGROUND OF THE INVENTION

1. Field of the Invention

The present invention relates to a method of manufacturing a rust-preventing cover and to a rust-preventing cover manufactured by the method.

2. Description of the Related Art

From the time that assembly of a vehicle has been completed to the time that the vehicle is delivered to a dealer or to the purchaser, there are cases in which the automobile is exposed outdoors for a long period of time while being stored or the like. When the vehicle is left in this state, rust may form on the disc rotor, which is an important element of the disc brake device, or the like. Therefore, conventionally, a rust-preventing cover has been used. The following four characteristics are required of a rust-preventing cover: the rust-preventing cover must ensure the rust-proof state of the disc rotor (first requisite characteristic (basic requisite characteristic)); the rust-preventing cover must not deform (open) from the time the cover is shipped from a factory as a product to the time that it is delivered to an assembly factory to be mounted to a vehicle, nor at the time when the rust-preventing cover is mounted to the vehicle on an assembly line at the assembly factory (second requisite characteristic); the rust-preventing cover must not come off easily after being mounted to the vehicle (third requisite characteristic); and the rust-preventing cover must be able to be removed easily when it is not needed (fourth requisite characteristic).

Japanese Utility Model Application Laid-Open JP-U-57-80734 discloses such a rust-preventing cover. The structure disclosed in this publication will be briefly described hereinafter.

As illustrated in FIG. 13, a rust-preventing cover 150 is formed in a substantially annular configuration, and includes a hat portion 152 forming the general surface, a bridge portion 154 which is narrow and formed by cutting away a portion of the hat portion 152, and a pair of flat abutment portions 156 which connect the hat portion 152 and the bridge portion 154. A pair of engagement projections 158 for mounting are formed at predetermined positions in the peripheral direction of the hat portion 152. A leg portion 160, which is used as a handle when the rust-preventing cover 150 is to be removed, is formed integrally with the hat portion 152 at the side thereof opposite the bridge portion 154.

A detent portion 162, which projects outwardly in the radial direction, is formed integrally with the central portion of the bridge portion 154. A first slit 164 is formed at the axis side of the detent portion 162. A second slit 166 is formed between the detent portion 162 and one of the abutment portions 156.

The rust-preventing cover 150 is interposed between an unillustrated disc portion of a disc wheel supporting the tire and an unillustrated disc rotor which is an important element of the disc brake device. In this way, the rust-preventing cover 150 has the first requisite characteristic, which is ensuring that the disc rotor remains rust-proof.

By disposing the detent portion 162 between a pair of claw portions of a caliper, the rust-preventing cover 150 is prevented from turning with respect to the caliper. Further, in this state, end portions of torque members of the caliper abut the pair of abutment portions 156, and the engagement projections 158 engage with the outer peripheral portion of an unillustrated dust cover disposed at the inner side of the disc rotor. The rust-preventing cover 150 is thereby in an elastically mounted state. In this way, the rust-preventing cover 150 has the third requisite characteristic that the rust-preventing cover 150 is not easily removed after mounting to the vehicle.

The following drawbacks are noted when considering the degree to which the rust-preventing cover 150 achieves the second and fourth requisite characteristics.

The rust-preventing cover 150 is often manufactured by a so-called DFM (dry fiber mold) process in which wood chips are made into fibers which are used to prepare a board which is molded into a flat plate shape and used as a base, and thereafter, the board is die cut and then press molded. In this case, because the rust-preventing cover 150 is formed from a material including wood fibers which have a relatively high bonding strength, the rust-preventing cover 150 does not deform (does not open) from the time the cover is shipped from a factory as a product to the time that it is delivered to an assembly factory. In this way, the rust-preventing cover 150 has one part of the second requisite characteristic. However, because the bonding strength is relatively high and the first slit 164 and the second slit 166 are provided, a drawback arises in that the rust-preventing cover 150 deforms easily when mounted to a vehicle in an assembly line at an assembly factory.

Further, in accordance with the above-described structure, by pulling in the direction of arrow A the leg portion 160 which is a handle, the rust-preventing cover 150 breaks from the second slit 166 and is removed. Here, the first slit 164 is formed in order to prevent the detent portion 162 from abutting against the claw portions of the caliper and the breaking force from being absorbed when the tensile force in the directions of arrows B acts on the bridge portion 154 due to the tensile force in the direction of arrow A. More specifically, due to the first slit 164, the detent portion 162 elastically deforms such that the direction of curvature is reversed, and thus, the breaking load concentrates at the second slit 166 and breaks this portion. However, because the bonding strength is high, the breakage strength of the second slit 166 is also high. The fourth characteristic which is the rust-preventing cover 150 being able to be easily removed when not needed is not achieved sufficiently.

SUMMARY OF THE INVENTION

In view of the aforementioned, an object of the present invention is to provide a method of manufacturing a rust-preventing cover and a rust-preventing cover manufactured by the method, in which sufficient strength of the rust-preventing cover during mounting thereof is ensured, and the rust-preventing cover can be easily removed when not needed.

A first aspect of the present invention is a method of manufacturing a rust-preventing cover comprising the steps of: a first step of pulverizing paper materials into fibers; a second step of dissolving the fibers in water to form an aqueous solution; a third step of immersing a porous mold into the aqueous solution and forming a paper fiber layer, which forms the rust-preventing cover, on a surface of the mold by applying a predetermined suction force from an interior of the mold.

A second aspect of the present invention is a method of manufacturing a rust-preventing cover in which, in the first aspect, a deterioration preventing material is added to the aqueous solution.

A third aspect of the present invention is a rust-preventing cover manufactured by the method of the first aspect or the method of the second aspect.

In accordance with the first aspect of the present invention, in the first step, the paper material is pulverized into fibers. In the second step, the aqueous solution is prepared by dissolving the fibers in water. Thereafter, in the third step, a porous mold is immersed in the aqueous solution, and a predetermined suction force is applied from the interior of the mold. The paper fiber layer is thereby formed on the surface of the mold. The rust-preventing cover is formed by the paper fiber layer obtained by the above processes.

In accordance with the first aspect, by adjusting the suction time in the third step, an arbitrary thickness of the rust-preventing cover is obtained. More specifically, the strength required during mounting can be ensured by controlling the thickness of the paper fiber layer forming the rust-preventing cover.

Moreover, when the conventional DFM manufacturing method is used, because the strength of a resultant rust-preventing cover is based on the bonding of wood fibers having a relatively high bonding strength, it is difficult to strike a balance between the strength required during mounting and a breakage strength which allows the rust-preventing cover to be broken easily when the rust-preventing cover is to be removed, and the strength tends to become greater than needed. As a result, slits must be formed in the rust-preventing cover. The slits are a cause of deformation during mounting of the rust-preventing cover to a vehicle. Further, when the rust-preventing cover is to be removed when not needed, the breakage strength is too high and removal is difficult. In contrast, the method of the present invention is based on the bonding of paper fibers having a relatively low bonding strength. Therefore, by controlling the thickness, it is easy to reach a balance between the strength required during mounting and a breakage strength which allows the rust-preventing cover to be broken easily during removal. Further, there is no need to provide slits or the like.

In general, in the present invention, the ensuring of the strength of the rust-preventing cover at the time of mounting is handled by controlling the thickness thereof. The removability of the rust-preventing cover is handled by utilizing paper fibers which have a relatively low bonding strength.

In accordance with the second aspect of the present invention, in the first aspect, a deterioration preventing material is added to the aqueous solution obtained in the second step. Therefore, it is difficult for the rust-preventing cover to deteriorate, and the durability of the rust-preventing cover can be improved without impeding the removability thereof.

In accordance with the third aspect of the present invention, a rust-preventing cover is manufactured in accordance with the manufacturing method of the first aspect or the second aspect. Therefore, a rust-preventing cover can be obtained in which both the required strength during mounting is ensured and the removability is improved. Further, a rust-preventing cover which is hard to deteriorate is obtained.

The above and other objects, features and advantages of the present invention will become apparent from the following description and the appended claims taken in conjunction with the accompanying drawings in which preferred embodiments of the present invention are shown by way of illustrative example.

BRIEF DESCRIPTION OF THE DRAWINGS

The invention will now be described with reference to the accompanying drawings wherein.

DESCRIPTION OF THE PREFERRED EMBODIMENTS

Hereinafter, an embodiment of the present invention will be described with reference to FIGS. 1 through 12.

Figure 10:
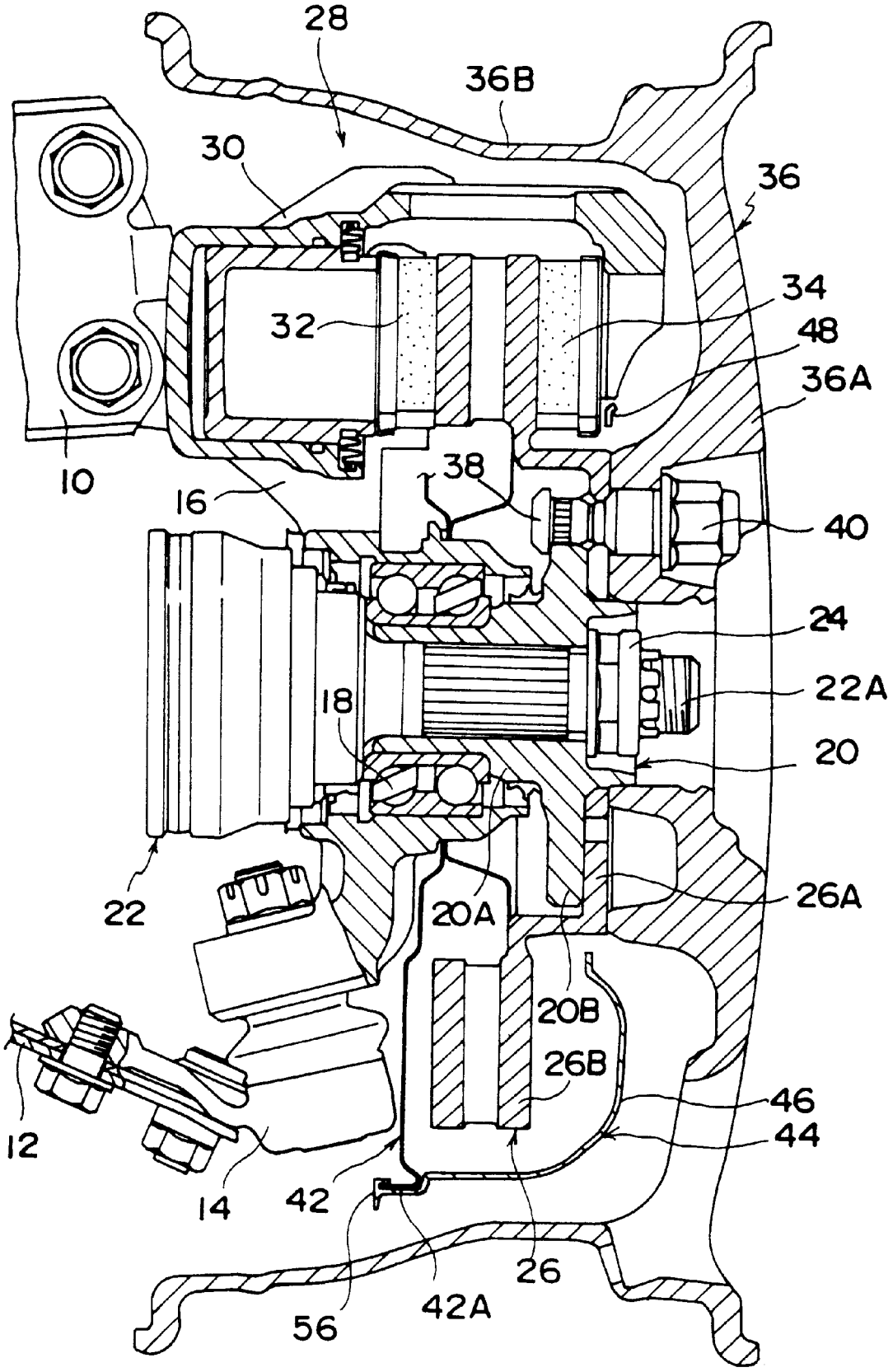
FIG. 10 is a longitudinal sectional view of a vicinity of a wheel of a vehicle, and illustrates a mounted state of the rust-preventing cover.

FIG. 10 illustrates the longitudinal cross-sectional structure of a vicinity of a wheel of a vehicle. As illustrated in FIG. 10, the lower end portion of a shock absorber is fixed to the upper portion of a steering knuckle 16 via a bracket 10. The outer end portion of a lower arm 12 is connected to the lower portion of the steering knuckle 16 via a lower ball joint 14. A boss portion 20A of an axle hub 20 is axially-supported at the axial portion of the steering knuckle 16 via an angular ball bearing 18. The boss portion 20A of the axle hub 20 is spline-fit with a small diameter shaft 22A of an axle 22. In this state, the axle hub 20 is fixed to the axle 22 by a nut 24 being screwed on the small diameter shaft 22A.

Further, a disc rotor 26 is disposed at the outer side of a flange portion 20B of the axle hub 20. The disc rotor 26 is formed by a mounting portion 26A and a flange portion 26B. The mounting portion 26A is shaped as a cylinder having a bottom, and is disposed so as to abut the flange portion 20B of the axle hub 20. The flange portion 26B extends outwardly in the radial direction from the outer peripheral portion of the mounting portion 26A. The disc rotor 26 is a portion of a disc brake device 28. A floating-type caliper 30, which is another portion of the disc brake device 28, is mounted to the steering knuckle 16. An inner pad 32 and outer pad 34 which are provided within the caliper 30 are disposed so as to oppose the outer peripheral portion of the flange portion 26B of the disc rotor 26.

A disc wheel 36 is disposed at the outer side of the disc rotor 26. The disc w heel 36 is formed by a disc portion 36A and a rim portion 36B. The disc portion 36A is disposed so as to abut the mounting portion 26A of the disc rotor 26. The rim portion 36B is cylindrical, is formed integrally with the disc portion 36A, and supports the tire. By fastening the disc portion 36A and the mounting portion 26A of the disc rotor 26 by a hub bolt 38 and a hub nut 40, the disc rotor 26 and the disc wheel 36 are fixed to the flange portion 20B of the axle hub 20.

A dust cover 42 is provided at the inner side of the flange portion 26B of the disc rotor 26 so as to cover the inner side surface of the flange portion 26B. A rust-preventing cover 44 is provided at the outer side of the flange portion 26B of the disc rotor 26 (between the flange portion 26B of the disc rotor 26 and the disc portion 36A of the disc wheel 3 6) so as to cover the outer side surface of the flange portion 26B. The dust cover 42 is provided to prevent dust or the like from adhering to disc rotor 26, whereas the rust-preventing cover 44 is provided to prevent the disc rotor 26 from rusting when the vehicle is stored over a long period of time or the like.

Figure 11:
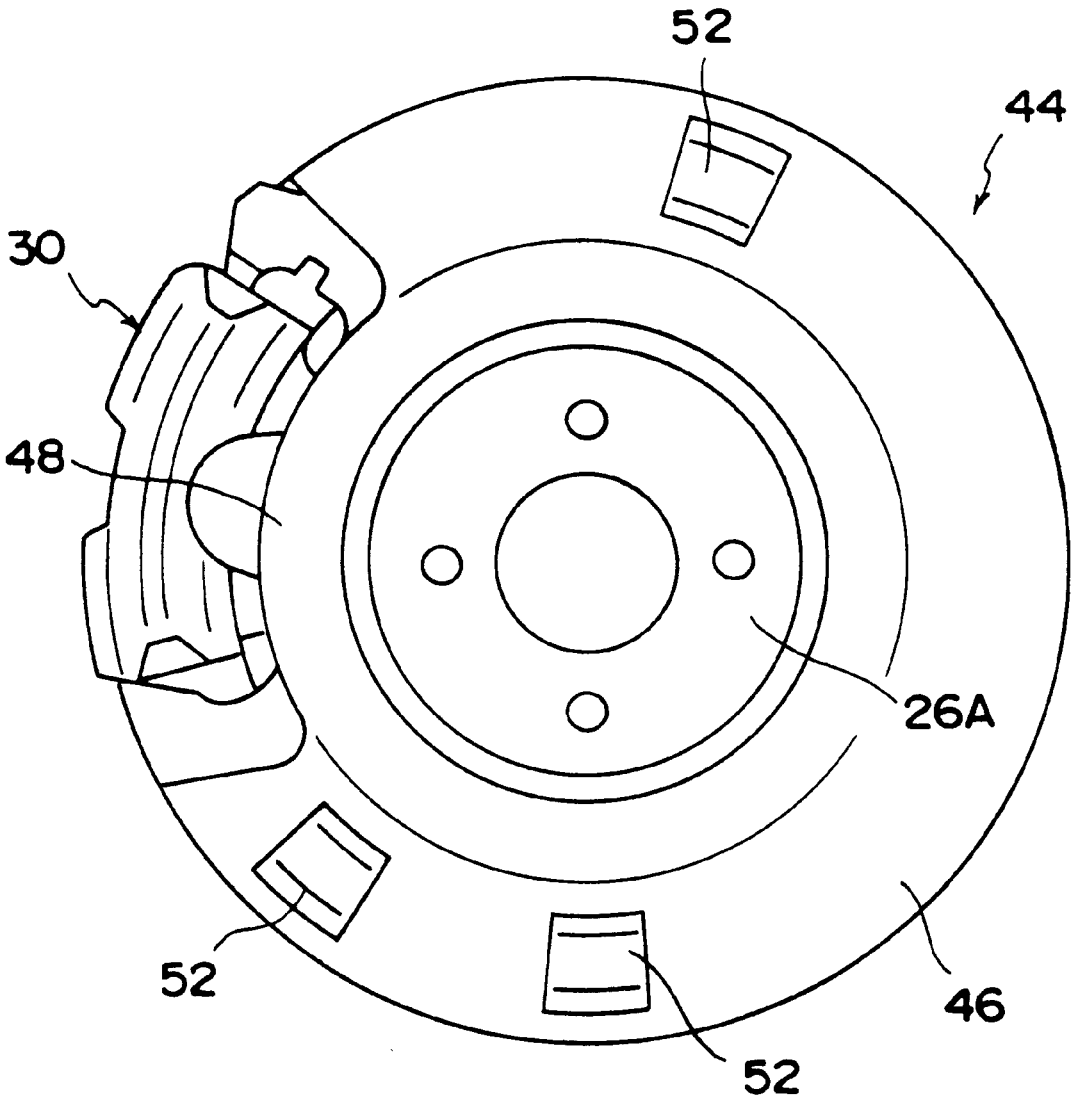
FIG. 11 is a front view, as seen from a side of a wheel, of a state in which the rust-preventing cover is mounted.

As illustrated in FIG. 11, the rust-preventing cover 44 includes a cover main body 46 which is hat-shaped and forms a general surface, and a bridge portion 48 which is narrow and formed by a portion of the cover main body 46 being cut away. The aforementioned caliper 30 is disposed at the cut away portion of the bridge portion 48. More specifically, in order to prevent interference with the caliper 30, the cut-away portion is provided so as to form the bridge portion 48. A handle 50 for removal (see FIG. 9) is formed integrally with the cover main body 46 at the side thereof opposite the side at which the bridge portion 48 is provided.

Figure 12A:
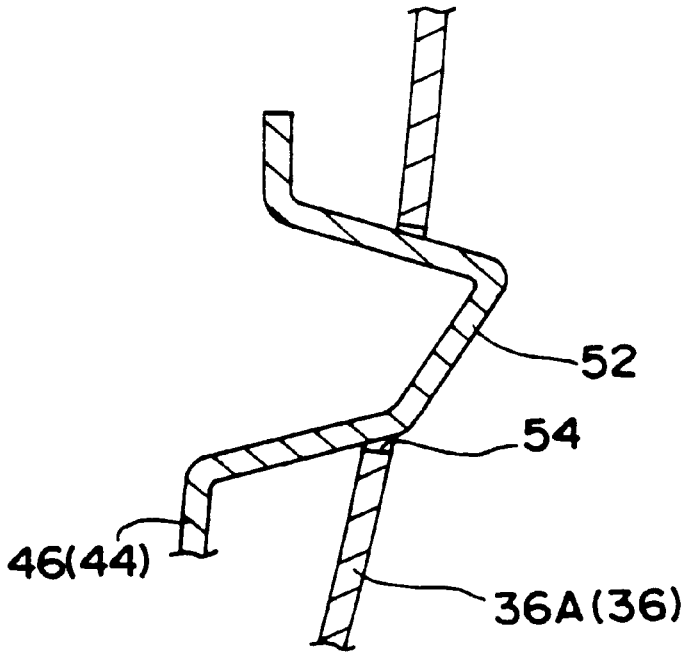
FIGS. 12A and 12B are perspective views illustrating the structure of engaging means used in mounting the rust-preventing cover.
Figure 12B:
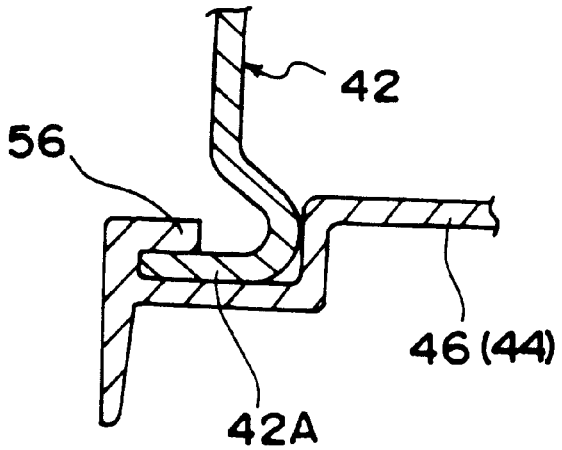
Figure 13:
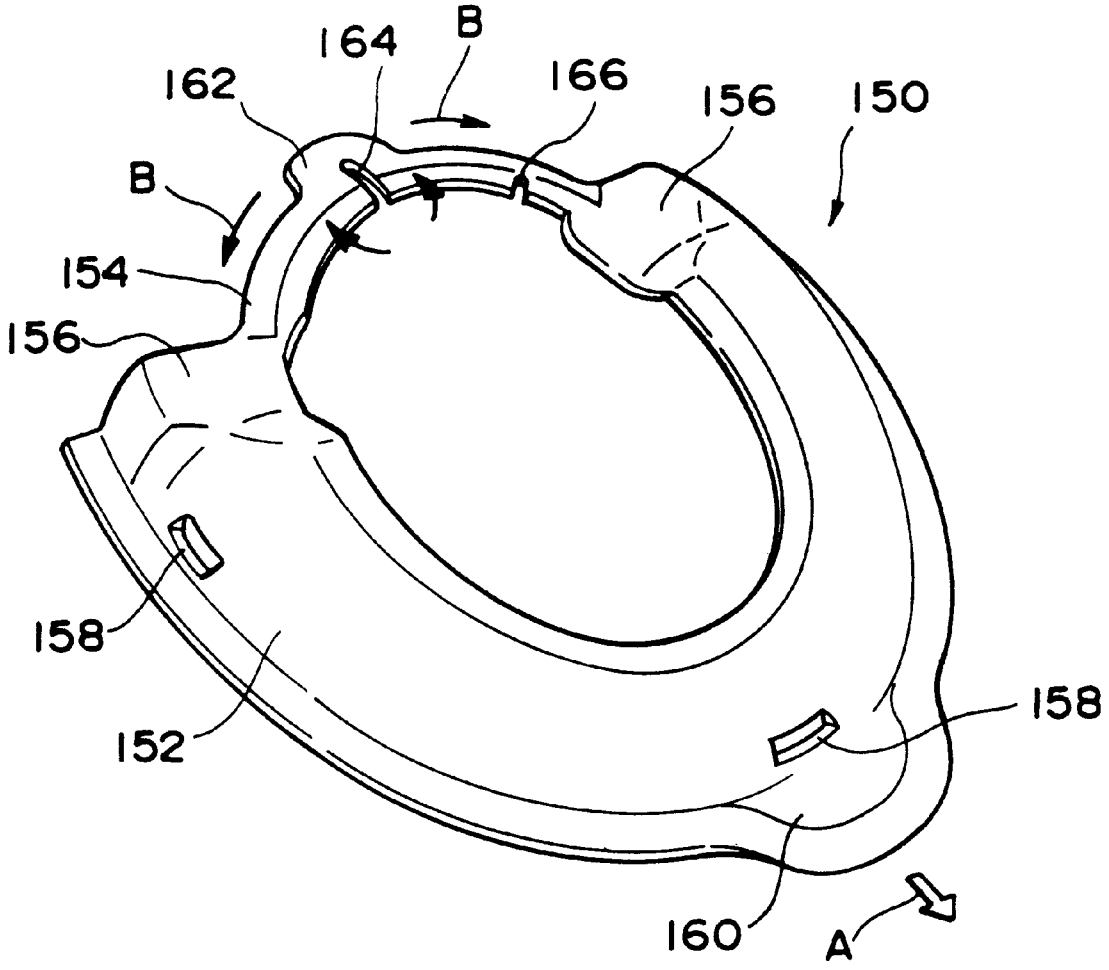
FIG. 13 RELATED ART
FIG. 13 is a perspective view illustrating the structure of a conventional rust-preventing cover.

Further, as illustrated in FIGS. 11 and 12A, a plurality of elastically deformable engagement projections 52 are formed integrally with predetermined positions of the outer peripheral portion of the cover main body 46. The engagement projections 52 elastically engage with the interiors of openings 54 formed in the disc portion 36A of the disc wheel 36 at predetermined intervals in the peripheral direction thereof. Further, as illustrated in FIGS. 10 and 12B, a hook-shaped engagement hooking portion 56 is formed integrally with a predetermined region of the outer peripheral edge of the cover main body 46. An outer peripheral edge 42A of the dust cover 42 elastically engages with the engagement hooking portion 56. The rust-preventing cover 44 is mounted to the disc wheel 36 and the dust cover 42 by the engagement projections 52 and the engagement hooking portion 56. Note that, other than the engagement projections 52 and the engagement hooking portion 56, any other engaging means which can reliably mount the rust-preventing cover 44 can be used.

Next, a method of manufacturing the above-described rust-preventing cover 44 will be described. The operation and effects of the present embodiment will be explained throughout the course of this description. The method to be described hereinafter is a WFM (wet fiber mold) manufacturing method.

First, the process for preparing the mixed aqueous solution, which is used as a raw material, is carried out.

Figure 1:
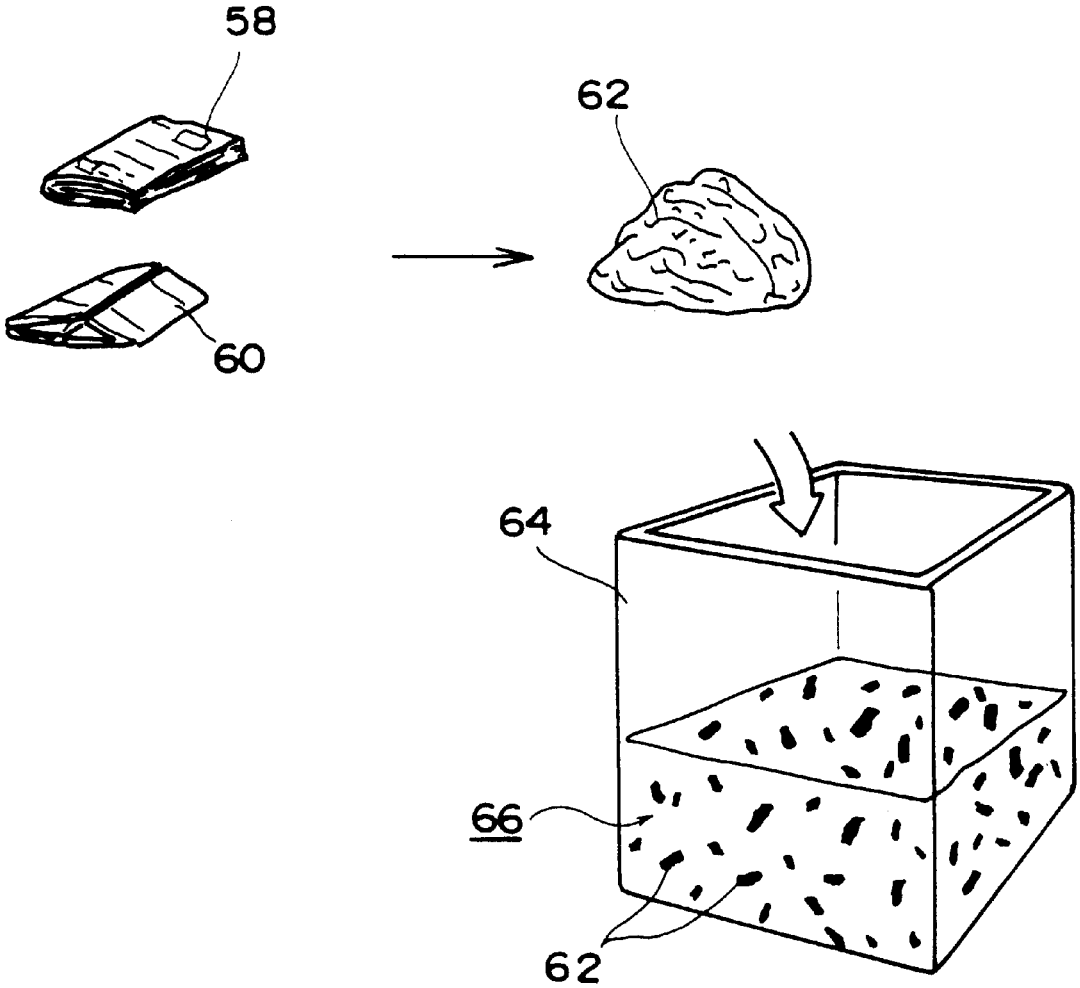
FIG. 1 is a process diagram illustrating the processes up to the formation of an aqueous solution in which paper fibers are dissolved.

As illustrated in FIG. 1, old newspapers 58 and cardboard boxes 60, which are paper materials which have been recovered by the collection of waste materials, are pulverized by an unillustrated mixer. In this way, the old newspapers 58 and cardboard boxes 60 are reduced to paper fibers 62. This process corresponds to the "first step" of claim 1.

Figure 2:
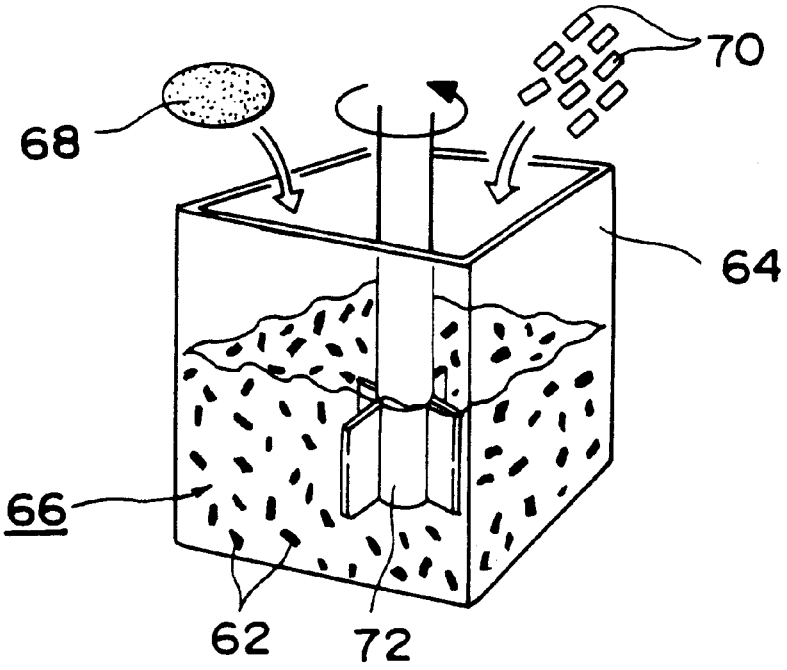
FIG. 2 is a process diagram illustrating the process of adding and stirring a water repellent and virgin pulp into the aqueous solution.
Figure 3:
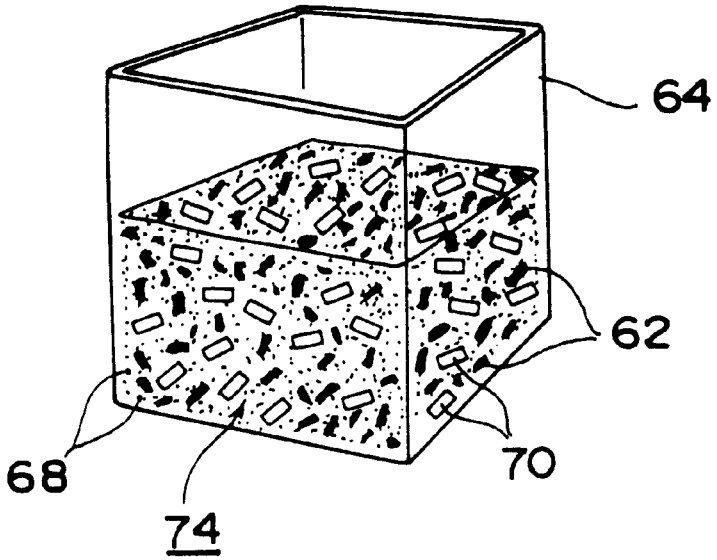
FIG. 3 is a process diagram illustrating a mixed aqueous solution obtained by the process illustrated in FIG. 2.

Next, the paper fibers 62 are placed in a water tank 64 so as to prepare an aqueous solution 66 in which the paper fibers 62 are dissolved in water. Then, as illustrated in FIG. 2, a water repellent 68, which serves as a deterioration preventing material, and virgin pulp 70 are placed in the water tank 64, and stirring is carried out by a stirrer 72. The water repellent 68 is added in order to prevent the rust-preventing cover 44 from absorbing rainwater, moisture, or the like after manufacture so that the rust-preventing cover 44 does not deteriorate any more than necessary. Although wax is used as the water repellent 68 in the present embodiment in consideration of the environment, resin may be used. Further, the virgin pulp 70 is added in order to control, to a certain extent, the strength of the manufactured rust-preventing cover 44. In this way, as illustrated in FIG. 3, a mixed aqueous solution 74 which is a raw material is completed. These processes correspond to the "second step" of claim 1.

Next, the process of suction into a rust-preventing cover mold is carried out.

Figure 4:
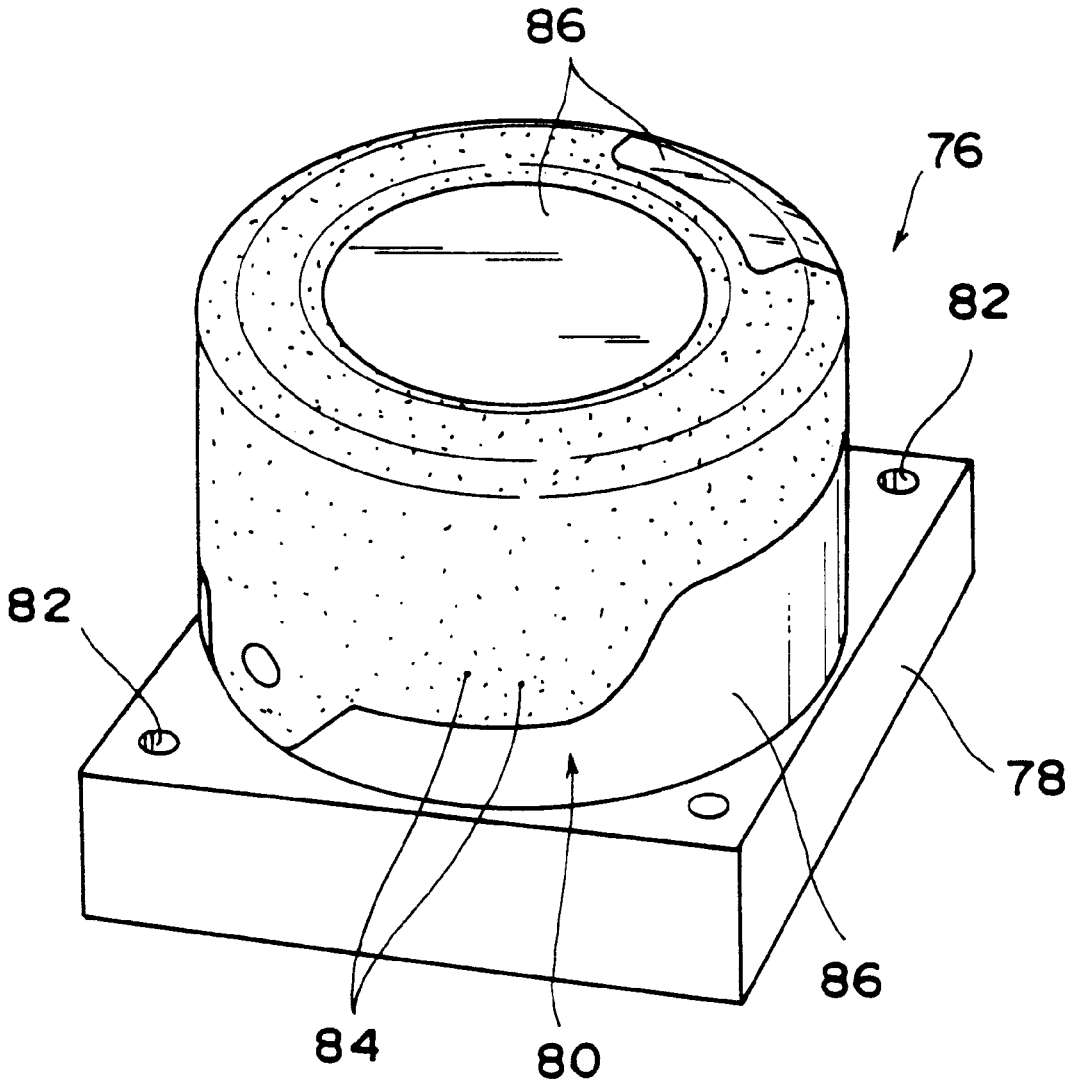
FIG. 4 is a perspective view of a rust-preventing cover mold used in a suction process.

As illustrated in FIG. 4, a rust-preventing cover mold 76 is formed of ceramic and includes a square, plate-shaped base 78 and a cylindrical mold main body 80 which rises up from the top surface of the base 78. The rust-preventing cover mold 76 is manufactured by being copied (traced) from a wooden mold. Bolt through-holes 82 are formed in the four corners of the base 78. A large number of suction holes 84 are formed in the top surface and the peripheral surface of the mold main body 80. (In FIG. 4, the suction holes 84 are illustrated by dots.) Further, masking 86, which is provided so that the paper fibers 62 are not sucked, is applied to a predetermined region of the top surface and a predetermined region of the peripheral surface of the mold main body 80. Suction processing as will be described hereinafter is carried out by using the rust-preventing cover mold 76.

Figure 5:
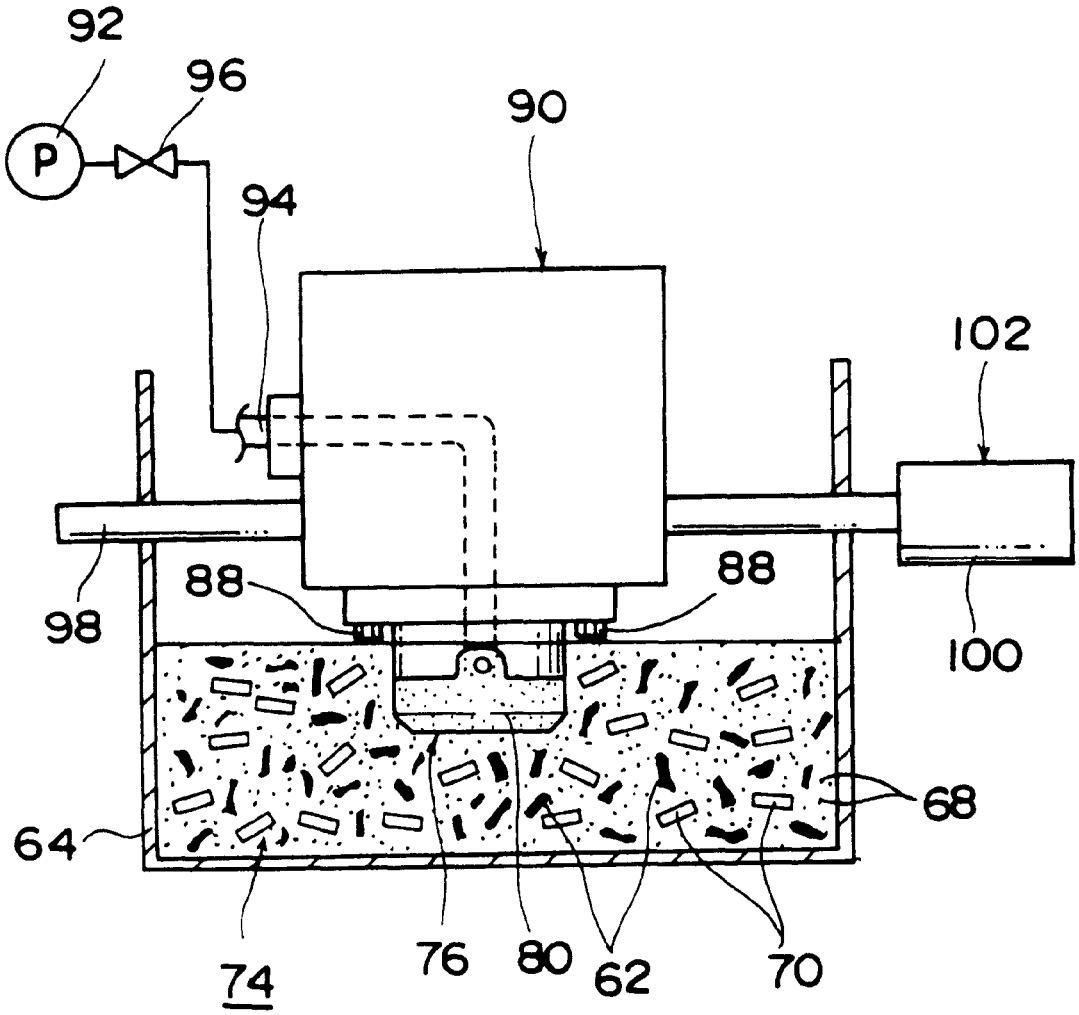
FIG. 5 is a process diagram illustrating a process in which the rust-preventing cover mold is immersed in the mixed aqueous solution and suction is carried out.

As illustrated in FIG. 5, first, the rust-preventing cover mold 76 is mounted to a work 90 by fixing bolts 88 being inserted through the bolt through-holes 82 of the base 78 and screwed with the work 90. A vacuum pump 92 which is a suction means is connected to the work 90 via a hose 94. By adjusting the degree of opening of a control valve 96, the suction rate and the like can be adjusted. A rotating unit 102, which includes a shaft 98 passing through the work 90 and a motor 100 provided at the end portion of the shaft 98, is provided at the work 90.

After the work 90 has been set at the water tank 64, while the motor 100 is driven and the work 90 rotated, the rust-preventing cover mold 76 is immersed in the mixed aqueous solution 74. Next, the vacuum pump 92 is driven and the mixed aqueous solution 74 is sucked. In this way, the mixed aqueous solution 74 is sucked from the suction holes 84 at portions other than the portions at which the masking 86 has been provided, so that a paper fiber layer 104 (see FIG. 6A) is formed on the surface of the portions other than those at which the masking 86 is provided. By adjusting the suction time of the vacuum pump 92, the thickness of the paper fiber layer 104 can be arbitrarily controlled. These processes correspond to the "third step" in claim 1.

Next, a drying process for removing moisture from the paper fiber layer is carried out.

Figures 6A, 6B, 6C:
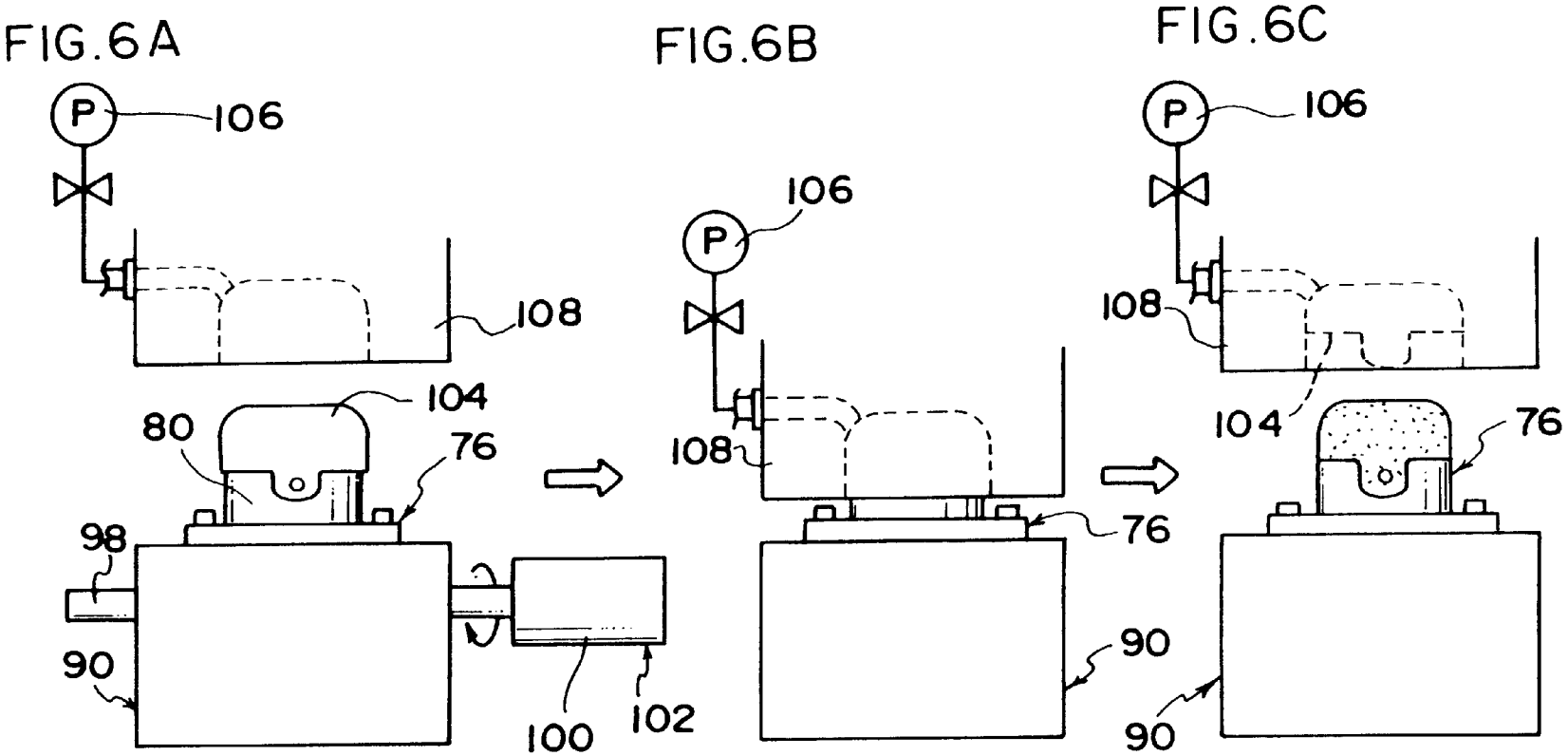
FIGS. 6A, 6B, and 6C are process diagrams illustrating processes until the rust-preventing cover is sucked by a vacuum pump.

First, as shown in FIG. 6A, the work 90 is removed from the water tank 64, the motor 100 is driven, and the rust-preventing cover mold 76 is inverted so as to face upward. Then, as illustrated in FIG. 6B, a suction mold 108 which is connected to another vacuum pump 106 is placed over the rust-preventing cover mold 76, and suction is carried out. In this way, as illustrated in FIG. 6C, the paper fiber layer 104 which forms the rust-preventing cover 44 is removed from the mold main body 80 and sucked into the suction mold 108.

Figure 7:
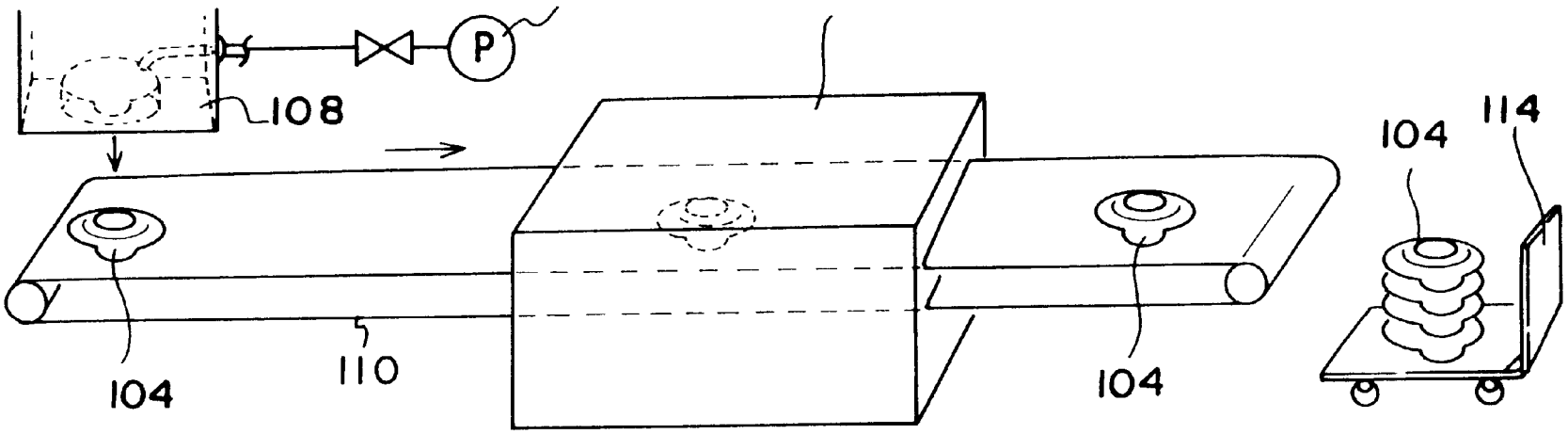
FIG. 7 is a process diagram illustrating a drying process.

As shown in FIG. 7, pressure is applied to the paper fiber layer 104 by driving the vacuum pump 106 reversely or the like. In this way, the paper fiber layer 104 separates from the suction mold 108 and drops down onto a belt conveyor 110. When the paper fiber layer 104 is conveyed by the belt conveyor 110 into a drying oven 112, the belt conveyor 112 is stopped temporarily and the paper fiber layer 104 is dried. When the paper fiber layer 104 has dried, the belt conveyor 110 is driven again, and the dried paper fiber layers 104 are stacked on a dolly 114. The longitudinal direction dimension of the drying oven 112, the drying temperature and the like may be set such that there is no need to stop the belt conveyor 110.

Next, the final pressing process for ensuring the precision of the manufactured product is carried out.

Figure 8:
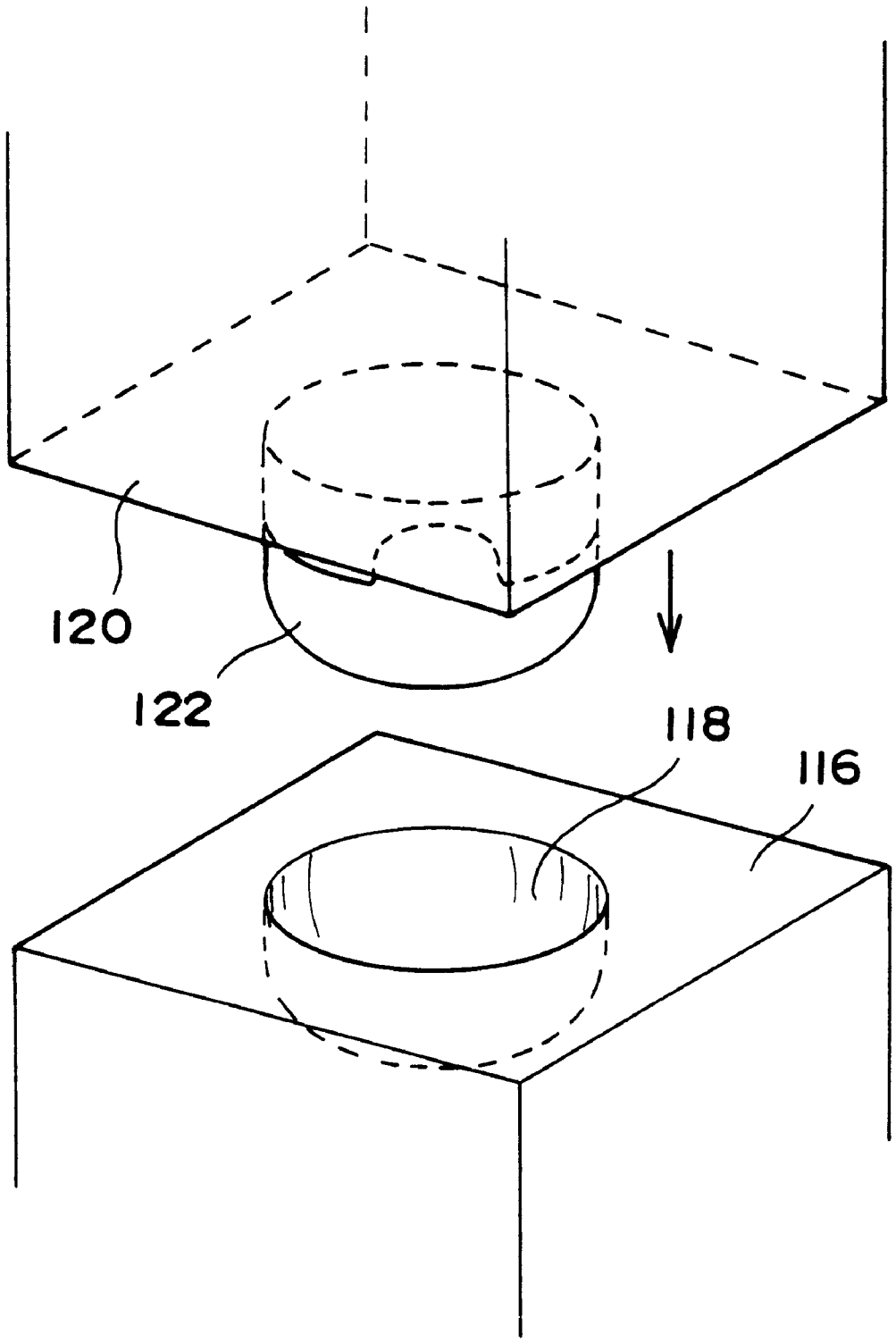
FIG. 8 is a process diagram illustrating a final molding process.
Figure 9:
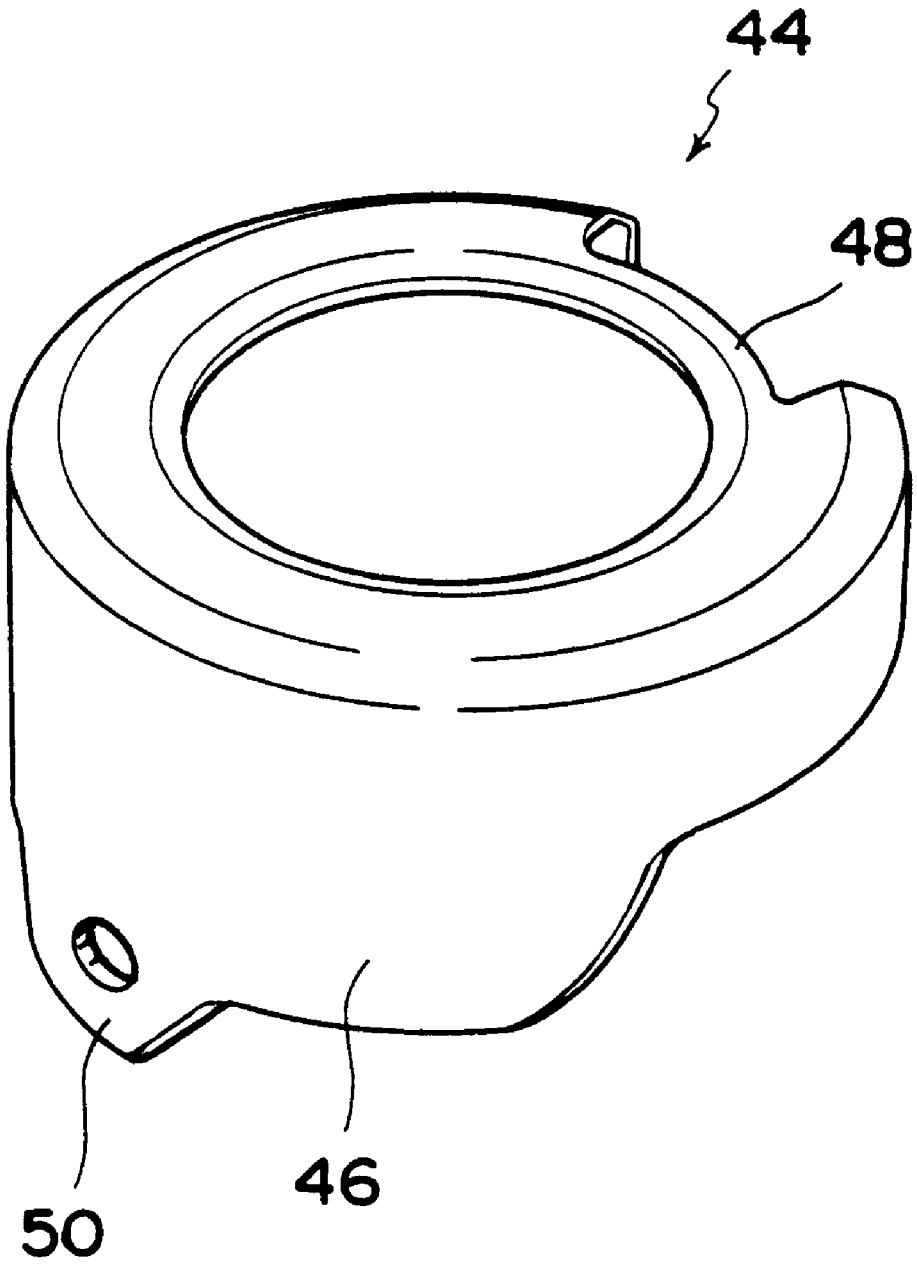
FIG. 9 is a perspective view illustrating a completed rust-preventing cover obtained by the above processes.

First, as shown in FIG. 8, one paper fiber layer 104 (not shown in the drawing) is set in a concave portion 118 of a bottom mold 116. Another paper fiber layer 104 is fit onto a convex portion 122 of a top mold 120. At this time, a mold release agent (oil) is applied to the inner peripheral surface of the concave portion 118 and to the outer peripheral surface of the convex portion 122. Next, the top mold 120 is pressed on the bottom mold 116, and the configurations of both of the paper fiber layers 104 are adjusted while the paper fiber layers 104 are subjected to pressure and heat molding. In this way, as illustrated in FIG. 9, the completed product of the rust-preventing cover 44, in which the paper fibers 62 are used as the main material, is obtained.

In the present embodiment, because the rust-preventing cover 44 is manufactured by a WFM manufacturing method instead of a conventional DFM manufacturing method, the following effects are achieved.

First, by adjusting the suction time of the vacuum pump 92 in the third step, a rust-preventing cover 44 of an arbitrary thickness can be obtained. More specifically, the strength of the rust-preventing cover 44 required at the time of mounting to the disc wheel 36 or the like can easily be ensured by controlling the thickness of the paper fiber layer 104 which forms the rust-preventing cover 44. Accordingly, the strength required from the time the rust-preventing cover 44 is shipped from a factory as a product to the time that it is delivered to an assembly factory can also sufficiently be ensured. As a result, the rust-preventing cover 44 does not deform (open) from the time it is shipped from a factory as a product to the time that it is delivered to an assembly factory, nor at the time when the rust-preventing cover 44 is mounted to a vehicle on an assembly line at the assembly factory (second requisite characteristic).

Further, in accordance with the present embodiment, a WFM manufacturing method, which is based on the bonding of the paper fibers 62 having a relatively low bonding strength, is used. Therefore, by controlling the thickness, a balance can easily be struck between the strength required for mounting and the breakage strength at which the cover easily breaks when removed. More specifically, in accordance with the present embodiment, because the rust-preventing cover 44 is formed by the paper fiber layer 104, when the rust-preventing cover 44 is to be removed when not needed, the rust-preventing cover 44 can be easily broken and removed by a worker inserting his/her hand from the outer side of the disc wheel 36, grasping the handle 50, and pulling. Thus, the rust-preventing cover 44 exhibits the fourth requisite characteristic of easy removal when not needed.

In general, in the present embodiment, the ensuring of the strength of the rust-preventing cover 44 at the time of mounting is dealt with by controlling the thickness thereof. The removability of the rust-preventing cover 44 is dealt with by utilizing the paper fibers 62 which have a relatively low bonding strength. In this way, both the second requisite characteristic and the fourth requisite characteristic can be achieved.

The rust-preventing cover 44 is mounted to the outer side of the disc rotor 26 by the engagement projections 52 elastically engaging the openings 54 in the disc wheel 36 and the outer peripheral edge 42A of the dust cover 42 elastically engaging the engagement hooking portion 56. In this way, the rust-preventing cover 44 ensures that the disc rotor 26 remains rustproof (the first requisite characteristic (basic characteristic)), and also the rust-preventing cover 44 cannot easily be removed after mounting thereof to the vehicle (the third requisite characteristic).

Further, in the present embodiment, the water repellent 68 which is a deterioration preventing material is added to the mixed aqueous solution 74 obtained in the second step. Therefore, the rust-preventing cover 44 can be prevented from easily deteriorating due to rainwater, moisture or the like.

In the present embodiment, the water repellent 68 serving as a deterioration preventing material is added. However, the water repellent 68 may be added as necessary, and does not necessarily have to be added.

What is claimed is:

1. A method of manufacturing a rust-preventing cover shaped to cover objects to prevent rust on said objects, comprising the steps of:

a first step of pulverizing paper materials into fibers;

a second step of dissolving the fibers in water to form an aqueous solution;

a third step of immersing a porous mold into the aqueous solution and forming a paper fiber layer, which forms said rust-preventing cover, on a surface of the mold by applying a predetermined suction force from an interior of the mold;

a fourth step of moving said rust-preventing cover formed at the third step to a suction mold from said porous mold by the suction of air from said suction mold using a vacuum pump; and a fifth step of removing said rust-preventing cover which is held at said suction mold, from said suction mold by the discharge of air into said suction mold from said vacuum pump.

2. The method of manufacturing a rust-preventing cover according to claim 1, wherein a deterioration preventing material is added to the aqueous solution.

3. The method of manufacturing a rust-preventing cover according to claim 2, wherein the deterioration preventing material is a water repellent.

4. The method of manufacturing a rust-preventing cover according to claim 3, wherein the water repellent is wax.

5. The method of manufacturing a rust-preventing cover according to claim 3, wherein the water repellent is resin.

6. The method of manufacturing a rust-preventing cover according to claim 1, wherein virgin pulp is added to the aqueous solution in order to control the degree of strength of a manufactured rust-preventing cover.

7. The method of manufacturing a rust-preventing cover according to claim 1, wherein when the predetermined suction force is applied from the interior of the mold during said third step, a suction time is adjusted in order to obtain a thickness of the paper fiber layer having strength required during mounting of said rust-preventing cover.

8. The method of manufacturing a rust-preventing cover according to claim 1, wherein a paper material used in said first step is at least one of old newspapers and cardboard boxes recovered by collection of waste materials.

9. The method of manufacturing a rust-preventing cover according to claim 1, wherein the mold in said third step is a ceramic mold manufactured by copying from a wooden mold.

10. The method of manufacturing a rust-preventing cover according to claim 1, further comprising:

a sixth step of removing moisture from the paper fiber layer, which is formed on the surface of the mold and forms said rust-preventing cover, by drying the paper fiber layer in a drying oven.

11. The method of manufacturing a rust-preventing cover according to claim 1, further comprising:

a sixth step of, in order to obtain said rust-preventing cover as a completed, manufactured good, setting one paper fiber layer in a concave portion of a bottom mold, placing another paper fiber layer on a convex portion of a top mold, pressing the top mold against the bottom mold, and subjecting both paper fiber layers to pressure and heat molding so as to adjust the configurations of the paper fiber layers.

* * * * *